United States Patent [19]

Hackbarth et al.

[11] 4,160,420

[45] Jul. 10, 1979

[54] ARTICULATED SCHNABEL CAR

[75] Inventors: Richard W. Hackbarth, Roseville; Douglas A. Puariea, St. Paul; Philip J. Kramlinger, Roseville, all of Minn.

[73] Assignee: The Maxson Corporation, St. Paul, Minn.

[21] Appl. No.: 831,366

[22] Filed: Sep. 8, 1977

[51] Int. Cl.[2] ..... B61D 3/16; B61D 49/00; B61F 1/10; B61F 5/22

[52] U.S. Cl. ..... 105/367; 105/183

[58] Field of Search ..... 105/159, 183, 367

[56] References Cited

U.S. PATENT DOCUMENTS

| | | | |
|---|---|---|---|
| 1,656,995 | 1/1928 | Wenzel | 105/183 |
| 2,089,110 | 8/1937 | Bugatti | 105/183 |
| 3,532,061 | 10/1970 | Bohm et al. | 105/367 X |
| 3,648,622 | 3/1972 | Lich | 105/367 |
| 3,788,237 | 1/1974 | Dieckman et al. | 105/367 |
| 3,837,295 | 9/1974 | Fedele | 105/367 |

FOREIGN PATENT DOCUMENTS

| | | | |
|---|---|---|---|
| 2414764 | 10/1975 | Fed. Rep. of Germany | 105/367 |

*Primary Examiner*—Albert J. Makay
*Assistant Examiner*—Howard Beltran
*Attorney, Agent, or Firm*—Neil B. Schulte

[57] ABSTRACT

A schnabel-type railroad car adapted to carry very large loads incorporating articulated end units having a massive hinge at a reduced pivot location so that the weight of the car can be carried at a central location on the trucks while still pivoting about a lesser radius to help negotiate tight turns. Special hydraulic systems permit the car to be raised and lowered and also shifted laterally to provide additional roadbed clearance.

6 Claims, 4 Drawing Figures

ARTICULATED SCHNABEL CAR

BACKGROUND OF THE INVENTION

Schnabel-type railroad cars are divisible into two identical parts so that a load can be supported between the two parts and thereby transported at a lower overall height. When the load has been delivered the two divisible portions of the car can be coupled together to form a unitary body which is returned to be used to carry another load.

With the development of ever increasingly large loads such as typified by electrical generators or nuclear reactors schnabel cars have grown ever larger in size presenting increasing problems in roadbed clearance. Car lengths have grown to the point where it may be difficult to negotiate tight turns in roadbeds originally designed for cars of a much shorter length. It thus becomes desirable to be able to pivot the load at the minimum length possible while still carrying the main weight of the load over a larger number of trucks. Accordingly reduced pivot schnabel cars have been developed which pivot at shorter radiuses but carry the load over longer lengths. Prior art designs have been exceedingly complicated and the design complications have been aggravated by the desire to provide vertical adjustment to the load in order to permit the car to negotiate existing underpasses. Our invention provides a much simplified design which permits the desired articulation of the car utilizing reduced pivots, lateral displacement of the load, and vertical displacement of the load.

BRIEF SUMMARY OF THE INVENTION

Briefly, the present invention contemplates a massive hinge utilizing top and bottom flanges to carry the horizontal bending loads and a central cantilevered arm to carry the vertical shear load. This massive hinge is located at the reduced pivot point and permits the bending and vertical shear loads to be carried through past the reduced pivot point to a position more centrally located on the trucks. It may therefore be seen that it is an object of our invention to provide an improved schnabel car design which is less complicated and therefore easier to maintain and operate. Further objects and advantages will become apparent from the following detailed description and drawings.

DESCRIPTION OF THE PREFERRED EMBODIMENT

Figure 1:
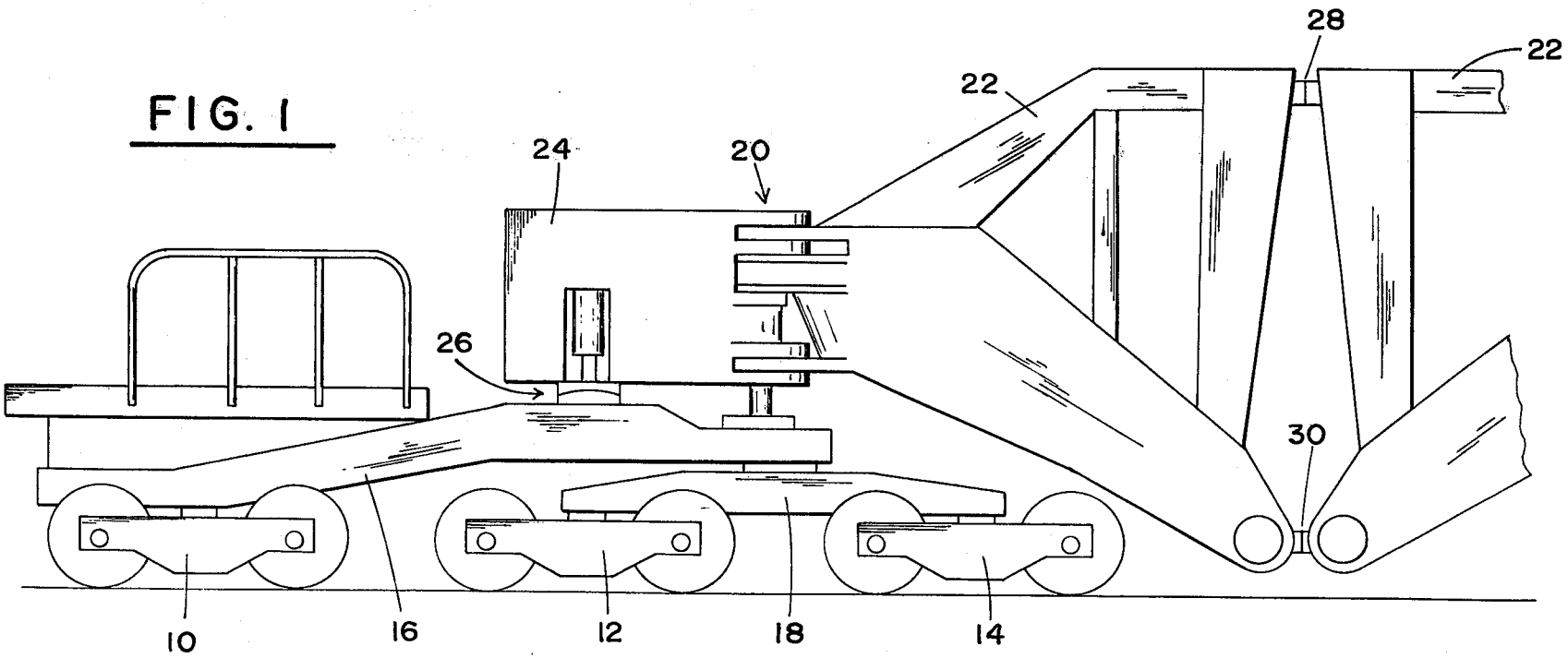
FIG. 1 is an overall schematic drawing of one of the two divisible units of the schnabel car.

In FIG. 1 one-half of the schnabel car is shown along with a fragmentary portion of the other half. Since both halves are mirror images of each other all of the structure explained hereinafter may be considered to be a portion of the other half of the car as well. Several wheeled trucks 10, 12, and 14 are connected together by suitable span bolster members 16 and 18 forming articulated end units in a manner well known to those skilled in the art. The massive hinge contemplated by the present invention is shown generally at 20. Hinge 20 permits the loads carried by schnabel frame 22 to be carried through into a torque box 24 which is supported on bolster 16 by means of a pair of suitable bearings 26. In service, a load is carried between the two schnabel frames 22. The load is provided with mating fasteners which engage the two compression fastening devices 28 at the top of schnabel frames 22 and the two tension fastening members 30 at the bottom of schnabel frames 22. In FIG. 1 fasteners 28 and 30 are simply connected to each other to permit the entire schnabel car to be moved without a load.

Figure 2:
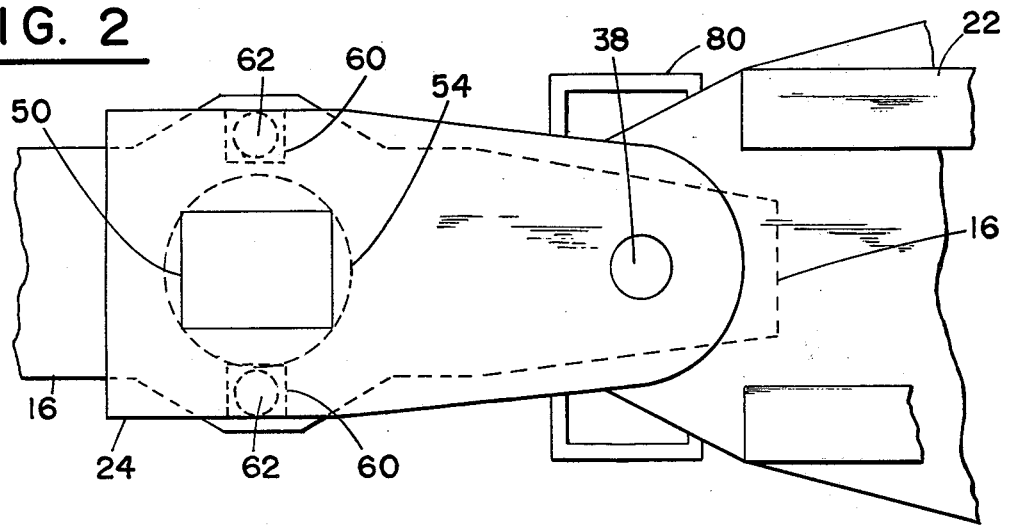
FIG. 2 is a top fragmentary view of the new and novel hinge portion of the car.
Figure 3:
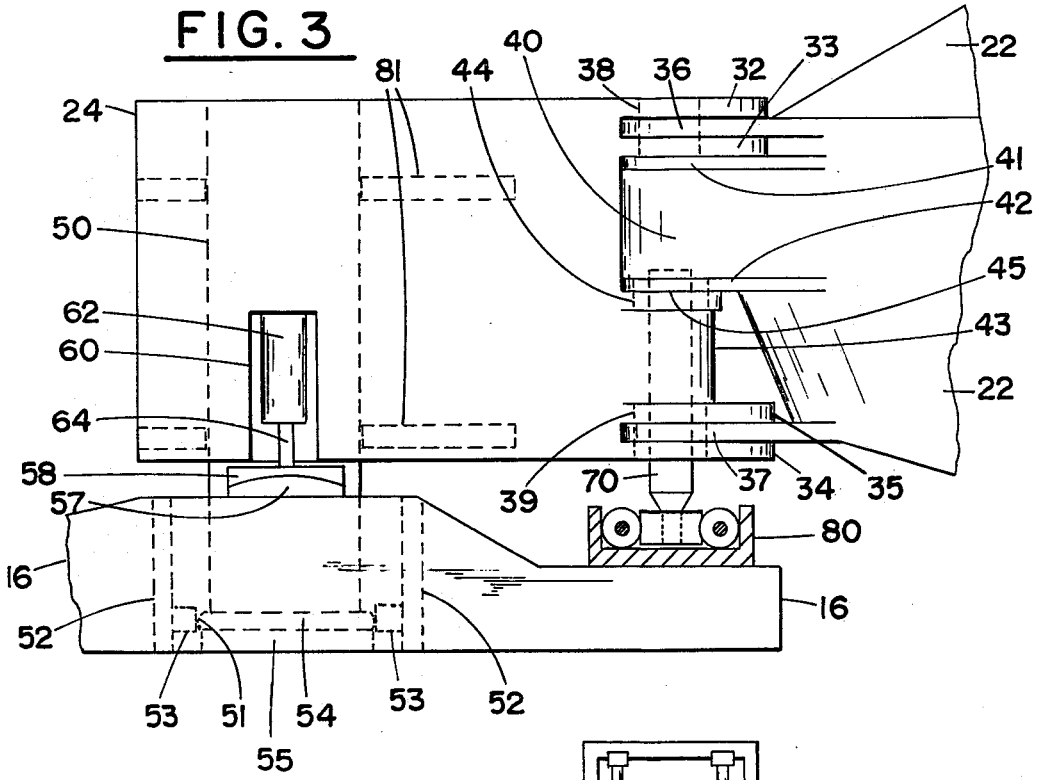
FIG. 3 is an elevational fragmentary view of the hinge portion shown in FIG. 2.

The design of torque box 24 and hinge 20 may be better seen by reference to FIGS. 2 and 3. Hinge 20, as shown in FIG. 1, is constructed generally on the right hand portion of torque box 24 and comprises a top pair of flanges 32 and 33 which engage therebetween a flange 36 from support structure 22. These flanges pivot relative to each other about a hinge pin 38 permitting the horizontal compression bending forces caused by the car and load weight to be transferred from the schnabel frame 22 to torque box 24. Torque box 24 includes another pair of flanges 34 and 35 at the bottom which engage a flange 37 extending from support structure 22. Another hinge pin 39 permits pivoting movement between these two members to absorb horizontal tensile bending forces. The hinges are adequate to transmit the longitudinal coupler loads and transverse torque loads as well as the bending loads. The combination of the two pins 38 and 39 are vertically separated and therefore very strong.

Vertical force from the schnabel frame 22 is carried through a centilevered arm 40 which may be reinforced by additional flanges 41 and 42. Arm 40 rests on a suitable mating arm 43. Arm 43 extends out from torque box 24. If desired an additional thrust pin 44 may be incorporated to hold a pin 70 in alignment. In the preferred embodiment it is contemplated that a suitable bearing surface 45, such as polytetrafloroethylene may be provided to assist relative movement between arms 40 and 43.

The forces in torque box 24 are transferred to span bolster 16 by means of a very large pin 50 which is generally rectangular in configuration where it passes through torque box 24. Pin 50 has a circular bearing plate 54 at the bottom within the span bolster 16. Thus, pin 50 can pivot within bolster 16 through a small arc although it should be understood that the main pivoting action on the car takes place about the reduced pivot location formed by hinge 20. Horizontal thrust loads are transmitted between pin 50 and bolster 16 by means of suitable internal support structure 52 which includes an edge bearing surface 53 and a support plate 55.

Bearing plate 54 has rounded edges 51 to permit pin 50 to tip laterally and longitudinally with respect to the span bolster 16. No vertical loads are carried by pin 50. Torque box 24 is free to move up and down on pin 50. Plate 55 supports pin 50 in position to receive horizontal loads on bearing plate 54. Bearing flanges 81 transmit the horizontal car loading from the pin 50 to the torque box 24. Bearings 26 comprise a lower convex bearing block 57 which supports a closely mated upper concave bearing block 58. Torque box 24 includes recesses 60 on each side which contain a pair of hydraulic cylinders 62 connected to bearing blocks 58 on each side by means of an extensible actuating rod 64. Accordingly, a hydraulic power system may be utilized in a manner well known to those skilled in the art to raise and lower the car to any desired position. As torque box 24 slides up and down along pin 50 it will be seen that all vertical forces on torque box 24 will be transmitted to span bolster 16 through the hydraulic cylinders and the mated bearing blocks 57 and 58. The curved mating surface between blocks 57 and 58 permit the car to tilt fore and aft to accommodate unevenness in the roadbed and differential vertical lifting from end to end while still supporting the vertical forces.

Figure 4:
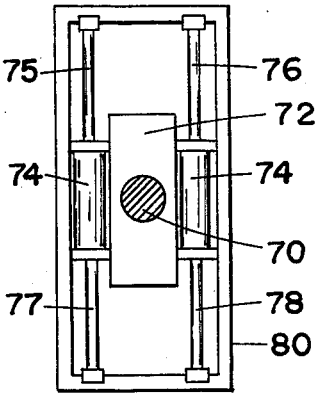
FIG. 4 is a detail drawing showing the hydraulic mechanism for moving the load laterally.

Lateral movement of the load at the reduced pivot point is made possible by a pair of double acting hydraulic cylinders 74 which may be seen in FIGS. 3 and 4. A side shift pivot pin 70 is inserted at hinge 20 through thrust pins 39 and 44 so as to be free to slide vertically relative to torque box 24. The lower end of pin 70 engages a support member 72 which is firmly attached to the double acting hydraulic cylinders 74. Cylinders 74 can be caused to move hydraulically along their actuating rods 75, 76, 77, and 78 so as to move pin 70 laterally left or right to displace the load and articulate the car around tight turns and other obstructions. Actuating rods 75 through 78 are mounted in a suitable support structure or box 80 which is welded or otherwise secured to the top of span bolster 16. Thus, pin 70 carries no vertical or longitudinal loads but serves only to locate the pivot axis of hinge 20. It therefore may be seen that our invention provides a simple straight forward schnabel car design in which a massive hinge structure of new and novel configuration permits all horizontal and vertical forces to be transmitted through torque box 24 to bolster 16 at a convenient location central to the truck assemblies while still maintaining a reduced pivot point which if desired can be moved laterally to articulate the car and increase the car's utility. Vertical adjustment is also possible in our invention without the necessity of removing or adding components since the vertical and lateral movements do not interfere with the normal hinge action of torque box 24.

We claim:

1. A schnabel-type railway car comprising a pair of separable end units adapted to be interconnected and to be connected to each end of a load carried therebetween in which each end unit comprises:

load support members;

a plurality of trucks connected together by span bolster members;

a torque box carried at a first end on said span bolster members, said torque box including a massive hinge at the other end adapted to engage the load support members, the pivot axis of said hinge forming a reduced longitudinal distance of pivoting between the end units;

load force transfer means at the first end of the torque box including a vertical pin rotatably carried by said span bolster and slidably inserted into said torque box so as to transfer horizontal forces and further including bearing pad means between said bolster members and said torque box so as to transfer vertical forces; and lateral position determining means on said bolster members connected to said hinge at said reduced pivot axis so as to adjust the lateral position of said reduced pivot axis.

2. The car of claim 1 in which said lateral position determining means comprises hydraulic cylinder means connected to move a second vertical pin, which second pin is slidably inserted in said torque box along an axis coincident with said reduced pivot axis.

3. The car of claim 1 in which said bearing pad means comprise on each side of the torque box a lower convex bearing surface carrying an upper concave bearing surface, said upper surface supporting vertically operating hydraulic cylinder means mounted to said torque box to permit the box to be vertically adjusted relative to the span bolster, and said convex and concave bearing surfaces permitting the torque box and the load to tilt relative to the span bolster.

4. The car of claim 1 in which said hinge comprises upper and lower flanges on the torque box which pivotally engage upper and lower flanges on the load support members so as to transfer horizontal forces and a central cantilevered arm on the torque box carrying a cantilevered arm from the load support member with a bearing surface therebetween so as to transfer vertical forces.

5. The car of claim 4 in which said lateral position determining means comprises hydraulic cylinder means connected to move a second vertical pin, which second pin is slidably inserted in said torque box along an axis coincident with said reduced pivot axis.

6. The car of claim 5 in which said bearing pad means comprise on each side of the torque box a lower convex bearing surface carrying an upper concave bearing surface, said upper surface supporting vertically operating hydraulic cylinder means mounted to said torque box to permit the box to be vertically adjusted relative to the span bolster, and said convex and concave bearing surfaces permitting the torque box and the load to tilt relative to the span bolster.

* * * * *